US009897112B2

(12) United States Patent
Gomm et al.

(10) Patent No.: US 9,897,112 B2
(45) Date of Patent: Feb. 20, 2018

(54) SMOOTH CONTROL OF HYDRAULIC ACTUATOR

(71) Applicant: Parker-Hannifin Corporation, Cleveland, OH (US)

(72) Inventors: Ralf Gomm, Charlotte, NC (US); Dale Vanderlaan, Waxhaw, NC (US)

(73) Assignee: Parker-Hannifin Corporation, Cleveland, OH (US)

( * ) Notice: Subject to any disclaimer, the term of this patent is extended or adjusted under 35 U.S.C. 154(b) by 369 days.

(21) Appl. No.: 14/441,403

(22) PCT Filed: Nov. 7, 2013

(86) PCT No.: PCT/US2013/068945
§ 371 (c)(1),
(2) Date: May 7, 2015

(87) PCT Pub. No.: WO2014/074713
PCT Pub. Date: May 15, 2014

(65) Prior Publication Data

US 2015/0308463 A1 Oct. 29, 2015

Related U.S. Application Data

(60) Provisional application No. 61/723,421, filed on Nov. 7, 2012.

(51) Int. Cl.
*F15B 11/00* (2006.01)
*F15B 15/08* (2006.01)

(52) U.S. Cl.
CPC ..... *F15B 11/003* (2013.01); *F15B 15/08* (2013.01); *F15B 2211/20515* (2013.01);
(Continued)

(58) Field of Classification Search
CPC ..... F15B 11/003; F15B 15/08; F15B 2211/20515; F15B 2211/20538; F15B 2211/20561; F15B 2211/20569; F15B 2211/27; F15B 2211/30515; F15B 2211/327; F15B 2211/353; F15B 2211/633;
(Continued)

(56) References Cited

U.S. PATENT DOCUMENTS 5,537,819 A * 7/1996 Kobayashi ..... E02F 9/2228 60/459
7,134,528 B2 * 11/2006 Birbaumer ..... B66B 1/24 187/275
(Continued)

FOREIGN PATENT DOCUMENTS

| | | |
|---|---|---|
| EP | 0 498 610 | 8/1992 |
| EP | 0 955 415 | 11/1999 |
| WO | 2009/102740 | 8/2009 |

OTHER PUBLICATIONS

International Search Report and Written Opinion for corresponding Patent Application No. PCT/US2013/068945 dated Feb. 11, 2014.
(Continued)

*Primary Examiner* — Logan Kraft
(74) *Attorney, Agent, or Firm* — Renner, Otto, Boisselle & Sklar, LLP

(57) ABSTRACT

A method and system is provided for controlling a hydraulic actuator in a work machine by opening a load holding valve in a measured fashion in order to leak hydraulic pressure back into a depressurized portion of the hydraulic circuit, thereby minimizing or eliminating jerkiness in the actuator when the actuator is under an external load.

19 Claims, 3 Drawing Sheets

(52) U.S. Cl.
CPC ..... *F15B 2211/20538* (2013.01); *F15B 2211/20561* (2013.01); *F15B 2211/20569* (2013.01); *F15B 2211/27* (2013.01); *F15B 2211/30515* (2013.01); *F15B 2211/327* (2013.01); *F15B 2211/353* (2013.01); *F15B 2211/633* (2013.01); *F15B 2211/6346* (2013.01); *F15B 2211/6651* (2013.01); *F15B 2211/6653* (2013.01); *F15B 2211/761* (2013.01); *F15B 2211/851* (2013.01)

(58) Field of Classification Search
CPC ..... F15B 2211/6346; F15B 2211/6651; F15B 2211/6653; F15B 2211/761; F15B 2211/851; F15B 2211/8606
See application file for complete search history.

(56) References Cited

U.S. PATENT DOCUMENTS

| | | | |
|---|---|---|---|
| 7,243,494 | B2 | 7/2007 | Evans |
| 2007/0166168 | A1 | 7/2007 | Vigholm et al. |
| 2012/0216519 | A1 | 8/2012 | Peterson et al. |
| 2012/0260642 | A1 | 10/2012 | Opdenbosch et al. |

OTHER PUBLICATIONS

Written Opinion for corresponding Patent Application No. PCT/US2013/068945 dated Jan. 16, 2015.
International Preliminary Report on Patentability for corresponding Patent Application No. PCT/US2013/068945 dated Feb. 20, 2015.

* cited by examiner

SMOOTH CONTROL OF HYDRAULIC ACTUATOR

RELATED APPLICATIONS

This application is a national phase of International Application No. PCT/US2013/068945 filed on Nov. 7, 2013 and published in the English language, which claims the benefit of U.S. Provisional Application No. 61/723,421 filed Nov. 7, 2012, which is hereby incorporated herein by reference.

FIELD OF INVENTION

The present invention relates generally to hydraulic actuators, and more particularly to the control of hydraulic actuators in a smooth manner.

BACKGROUND

Hydraulic actuators may be held in place against an external load by a load holding valve in lieu of continuous operation of a hydraulic pump. Fluid in the circuit between the load holding valve and the hydraulic pump may become depressurized by leakage through the pump. Thereafter, when the load holding valve opens, the hydraulic actuator may jerk due to pressurized fluid between the load holding valve and the actuator rushing in to the depressurized zone between the valve and the pump.

US Patent Application Publication No. US20080295504 A1 (Method for controlling a hydraulic cylinder in a work machine) proposes a solution to this problem where the electrically driven hydraulic pump is driven in the "wrong direction" (i.e. in a direction that would normally cause extension of the actuator against the external load when the desired movement is actually in the opposite direction) when an operator command is given. The torque applied to pressurize the hydraulic line is based upon a pressure sensor reading taken immediately prior to starting the routine. A second alternative is proposed where the electrically driven hydraulic pump is driven in the "wrong direction" when an operator command is given, and the duration of pressurizing the hydraulic line is based upon a position sensor reading taken during the routine, with the routine being stopped when actuator motion is sensed to be in the "wrong direction".

SUMMARY OF INVENTION

The approach in US20080295504 A1 has three shortcomings: (1) A certain amount of time is required to pressurize the hydraulic line by running the pump in the "wrong direction" at first. The time depends on the amount of fluid to be compressed and on electrical and mechanical component response time. In any event, this delay will be noticed by the operator and perceived as a sluggish or slow responsive system. (2) A certain amount of energy is required to back-drive the motor in the "wrong direction" at first. The energy is spent on overcoming the electric machine and pump inertia, compressing the hydraulic fluid, and potentially starting to lift the load until motion is recognized by the sensor. This makes a system less efficient. (3) The decision as to how much or how long to pressurize the hydraulic line is based on pressure or position sensor feedback, adding a certain complexity and cost to the system.

In contrast, the present invention provides a method for controlling a hydraulic actuator (typically a cylinder) in a work machine by opening the load holding valve in a measured fashion in order to leak hydraulic pressure back into the depressurized portion of the hydraulic circuit, thereby minimizing or eliminating jerkiness in the actuator.

Therefore, according to one aspect of the invention, a method for smoothly controlling a hydraulic actuator configured to actuate an implement that is acted upon by an external load in a first direction, the method comprising the steps of receiving a command input to move the implement in the first direction; upon receipt of the command input, opening a load holding valve hydraulically connected between a pump and a side of the actuator upstream of the pump a first amount to create a leakage path, the first amount being less than fully open; equalizing pressure between the valve and the pump with pressure between the valve and the actuator; and after equalizing the pressure, fully opening the load holding valve.

Optionally, the method includes monitoring a command input device.

Optionally, the monitoring is continuous.

Optionally, the command input is a control signal generated by a user-controlled input device.

Optionally, the method includes monitoring pump pressure; and comparing the monitored pump pressure with a predetermined threshold.

Optionally, the method includes further opening the load holding valve if the predetermined pressure threshold is not met.

Optionally, the method includes fully opening the load holding valve when the predetermined pressure threshold is met.

Optionally, monitoring pump pressure includes monitoring an electric current produced by a motor mechanically coupled to the pump.

Optionally, the method includes controlling the pump to generate hydraulic pump flow as commanded by the operator interface.

Optionally, the method includes driving the pump with flow produced by the actuator via the external load.

Optionally, the method includes generating electricity via an electric machine mechanically coupled to the pump.

According to another aspect of the invention, a method for smoothly controlling a hydraulic actuator configured to actuate an implement that is acted upon by an external load in a first direction, the method comprising the steps of: receiving a command input to move the implement in the first direction; upon receipt of the command input, metering flow from the actuator via a load holding valve hydraulically connected between a pump and a side of the actuator upstream of the pump; equalizing pressure between the valve and the pump with pressure between the valve and the actuator; and after equalizing the pressure, metering flow from the actuator via the pump.

Optionally, the method includes monitoring a command input device.

Optionally, the monitoring is continuous.

Optionally, the command input is a control signal generated by a user-controlled input device.

Optionally, metering via the load holding valve includes partially opening the load holding valve.

Optionally, the method includes monitoring pump pressure; and comparing the monitored pump pressure with a predetermined threshold.

Optionally, the method includes further opening the load holding valve if the predetermined pressure threshold is not met.

Optionally, the method includes metering the flow via the pump when the predetermined pressure threshold is met.

Optionally, monitoring pump pressure includes monitoring an electric current produced by a motor mechanically coupled to the pump.

Optionally, the method includes controlling the pump to generate hydraulic pump flow as commanded by the operator interface.

Optionally, the method includes driving the pump with flow produced by the actuator via the external load.

Optionally, the method includes generating electricity via an electric machine mechanically coupled to the pump.

According to another aspect of the invention, a hydraulic actuation system includes a hydraulic pump; a load holding check valve upstream of the pump; a controller configured to generate and send command signals to the load holding check valve; wherein the load holding check valve is configured to partially open upon receipt of an open command signal, and wherein the load holding check valve is configured to fully open after pump pressure exceeds a predetermined pressure.

Optionally, the system includes a sensor configured to monitor pump pressure.

Optionally, the pressure sensor senses current generated by an electric motor mechanically coupled to the pump.

Optionally, the controller is configured to generate a control signal to fully open the load holding check valve after pump pressure exceeds a predetermined pressure.

Optionally, the system includes an inverter and an electric machine mechanically coupled to the hydraulic pump, the inverter configured to store electrical energy generated by the electric machine when the pump is driven by fluid flow.

The foregoing and other features of the invention are hereinafter described in greater detail with reference to the accompanying drawings.

DETAILED DESCRIPTION

Exemplary embodiments of the invention relate generally to hydraulic actuation systems for extending and retracting at least one asymmetric hydraulic cylinder in a work machine, such as but not limited to hydraulic excavators, wheel loaders, loading shovels, backhoe shovels, mining equipment, industrial machinery and the like, having one or more actuated components such as lifting and/or tilting arms, booms, buckets, steering and turning functions, traveling means, etc.

Presented is a method to provide smooth motion to a hydraulic actuator, without jerk or shock noticeable by the operator, when initiating a hydraulic actuator motion in the direction of an external load (often a lowering motion). Such a motion corresponds to electrical energy recuperation in an electro-hydrostatic actuation system. Exemplary embodiments are needed in electro-hydrostatic actuation systems because load holding valves are typically used to disconnect the hydraulic load from the pump and electrical machine. Then, the hydraulic circuit between the actuator and load holding valves are pressurized, while the circuit between the pump and load holding valve might not be pressurized. When a motion is initiated by simply opening the load holding valve, the resulting pressure equalization can cause sudden, undesired motion of the actuator resulting in a shock at the machine level.

In particular, described is an exemplary method of using proportional load holding valves and control thereof to address this problem without having to back-drive the motor in the "wrong direction" first.

Figure 1:
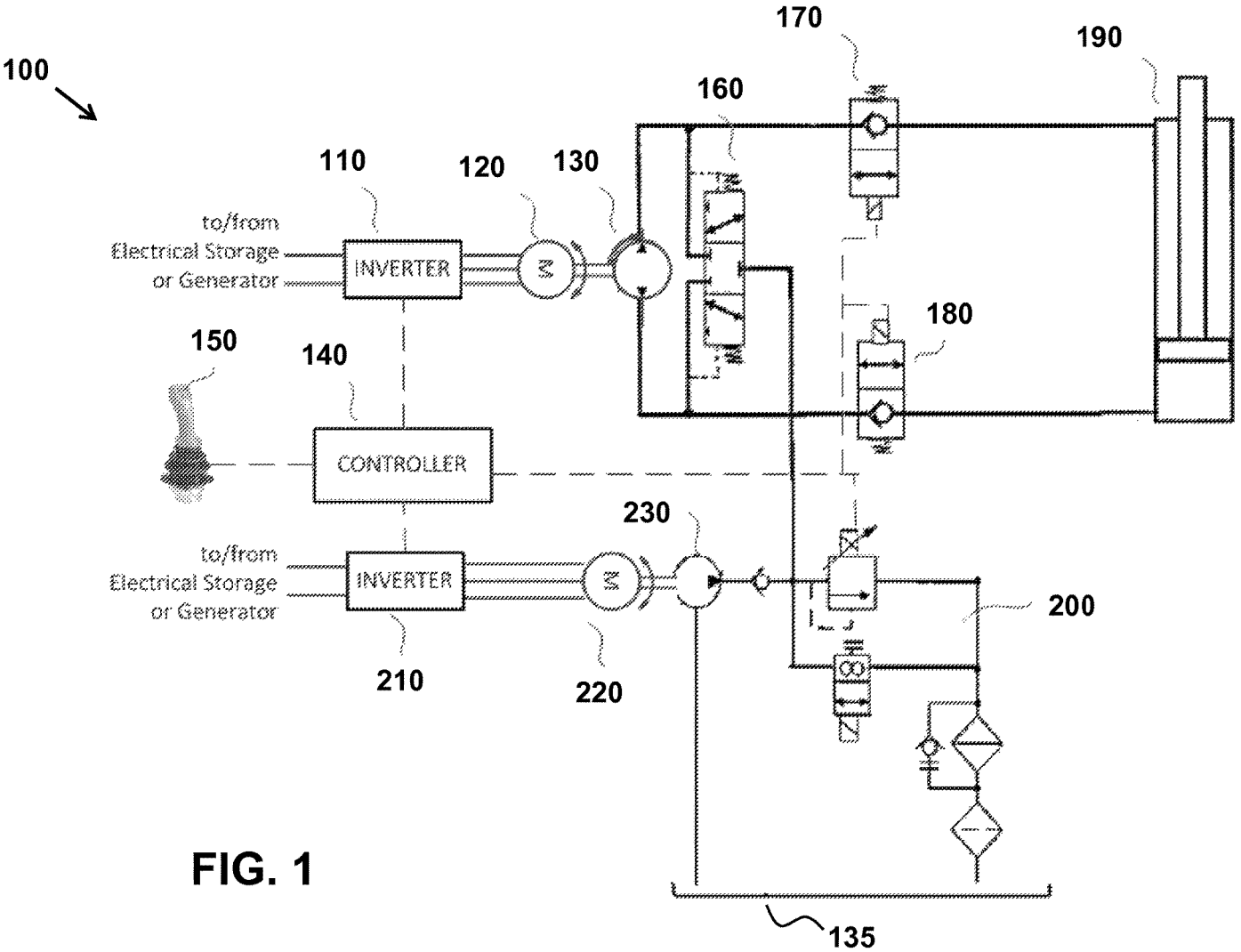
FIG. 1 illustrates an exemplary schematic embodiment of a system constructed in accordance with the present invention.

Referring in detail to FIG. 1, an exemplary embodiment of an electro-hydrostatic actuator system 100 is shown. The system includes at least one actuator 190 to be mechanically connected to a work machine and hydraulically connected to the system 100.

An inverter 110 may be connected to an electrical energy source such as an electrical storage (e.g., one or more batteries) or a generator and controls an electric machine 120 (e.g., an electric motor) in bi-directional speed or torque control mode. The electric machine 120 may be mechanically coupled to and drive a hydraulic pump 130, which may be any appropriate type, but is generally a fixed displacement, variable speed pump. The inverter may also store energy generated by the electrical machine in the storage when the pump is back-driven by hydraulic fluid, for example, during a down motion of the actuator when under an external load.

The operator of the system may command a desired actuator speed or force through an input device such as a joystick 150 connected to a controller 140. In other embodiments, a separate command controller may generate the command signal that is passed to the controller 140, for example if the work machine is being remotely or autonomously controlled.

The controller 140 issues commands to the inverter 110 which in conjunction with the motor 120 and pump 130 allows generation of bi-directional flow and pressure via the hydraulic pump 130. The flow is then directed through load holding valves 170, 180 to the actuator 190 yielding the desired actuator motion.

FIG. 1 shows the load holding valves 170, 180 as being ON/OFF type valves, however either or both of these valves could also be flow-control valves, orifice valves or any other proportionally adjustable valve. Exemplary valves are poppet valves so as to prevent leakage through the valves when the valves are closed.

Because most mobile machinery uses un-balanced actuators with a large and small volume chamber, a flow management system 200, for example as presented in U.S. Patent Application Publication No. 20110030364 A1 (incorporated herein by reference), controlled by a second inverter 210 and second electric machine 220 and second hydraulic pump 230, provides whatever input flow required by the actuator pump 130 via the shuttle valve 160.

During an actuator extend motion to lift a load, the actuator pump 130 provides flow into the large volume of the actuator 190 (the piston side) and the flow management system 200 is connected to the actuator pump inlet via the shuttle valve 160, ensuring that the flow difference of large volume minus small volume (the rod side) is provided to the actuator pump 130.

During an actuator retraction motion to lower a load, the actuator pump 130 consumes flow from the large volume of the actuator 190 and the flow management system 200 is connected to the actuator pump outlet via the shuttle valve 160, diverting excess flow of large volume minus small volume back to the flow management system 200 and ultimately to the hydraulic reservoir 135.

Although the actuator depicted in a cylinder, it is contemplated that other actuators are possible. Further, the orientation of the cylinder may be reversed from that which is shown.

Figure 2:
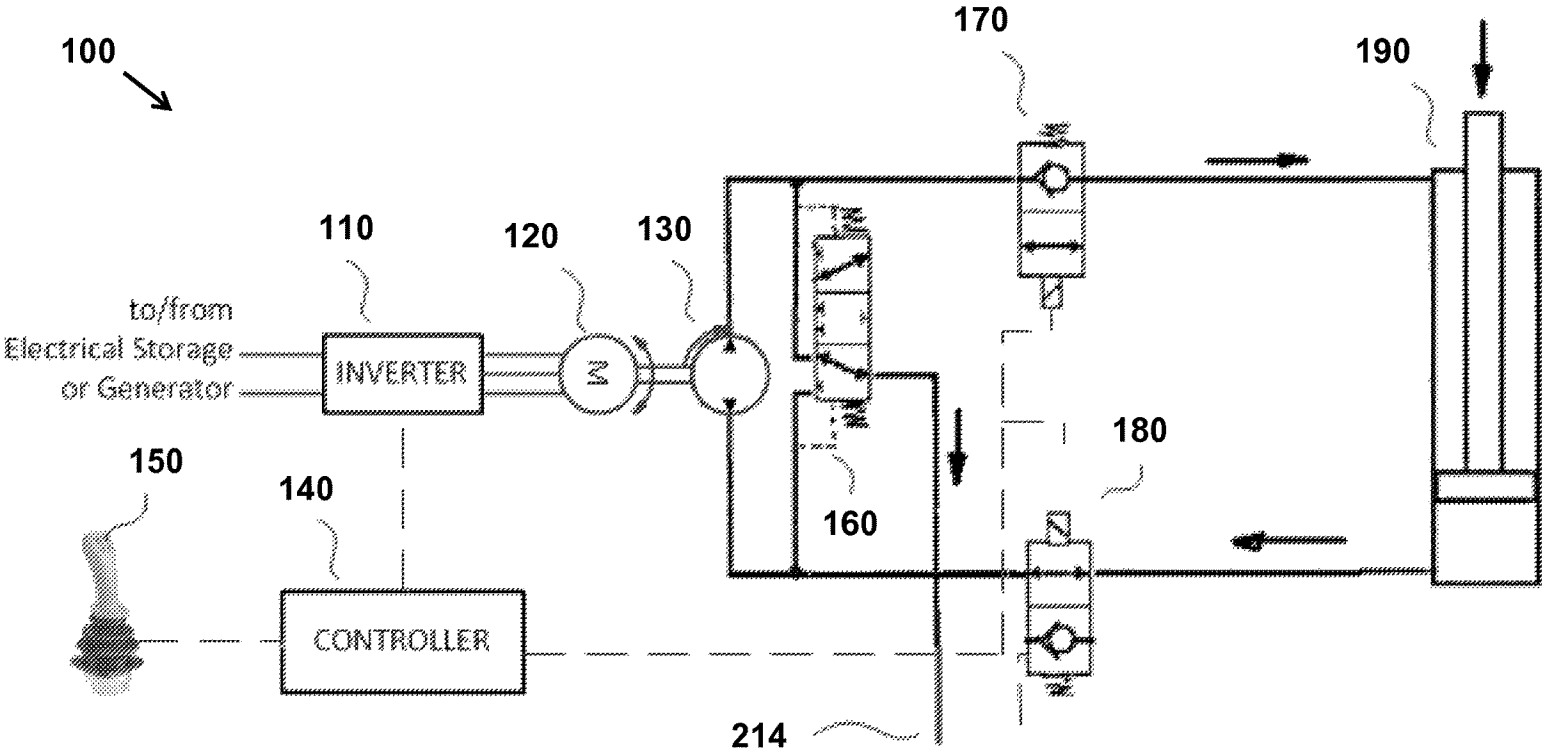
FIG. 2 illustrates an exemplary, simplified schematic embodiment of a system showing an actuator retraction motion, direction of fluid flow indicated by arrows and load holding valve states to enable this motion.

Referring now in detail to FIG. 2, an exemplary embodiment of an electro-hydrostatic actuator system 100 is shown. The system is the same as that shown in FIG. 1, except that the flow management system 200 is hidden to focus on operation of the remaining system. Hydraulic connection 214 indicates the to/from connection to the flow management system 200 shown in FIG. 1.

As shown, a hydraulic actuator 190 is mechanically connected to a work machine and hydraulically connected to the pump 130. The arrow above the actuator is used to indicate the direction of motion: retraction of the actuator. The remaining arrows indicate hydraulic fluid flow direction in the system. An inverter 110 is connected to an electrical energy source and controls an electric machine 120 in bi-directional speed or torque control mode. The electric machine is connected to the hydraulic pump 130. When the operator commands a desired actuator speed or force through the input device 150 connected to the controller 140, the controller issues commands to the inverter which, in conjunction with the motor and pump, generates bi-directional flow and pressure via the hydraulic pump 130. The hydraulic flow is then directed through the load holding valves 170, 180 to the actuator 190 yielding the desired actuator motion.

In order to enable an actuator retraction motion, load holding valve 180 may be commanded open, as indicated, to allow fluid flow from the large volume of the actuator back to the electrically driven pump 130. The load holding valve 170 does not have to be commanded open in this case, since the type of valve used in this example includes a check valve that will pass flow freely from pump 130 into the large volume of the actuator. However, it is contemplated that another valve type without this check feature could be utilized, in which case, an open signal would be generated to open this valve.

In general, when the operator does not command an actuator motion, both load holding valves 170, 180 will be closed to remove the hydraulic load from the pump, reduce consumption of electrical energy and prevent the load from dropping in case the pump drive source is turned off. This configuration will cause the pressure between the load holding valves and pump to decay over time, largely due to leakage in the pump (although leakage through other system components may also occur, e.g., through shuttle valve 160). The pressure between the load holding valves and actuator however remains at a level to support the external load without actuator motion.

As will be explained in more detail below in an exemplary method, the load holding valve 180 may be opened to allow metered flow therethrough. This metered flow reduces or eliminates the jerkiness of the actuator that would otherwise occur when the actuator is opened fully and quickly so as not to meter the flow. In such a case, the high pressure upstream of the valve would rush into the downstream side causing a jerking motion in the actuator. To prevent this rush of fluid, the valve 180 may meter flow by opening less than a full amount so as to form an orifice opening. A proportional valve may open in a stepwise manner before opening fully, or may continuously but slowly open in a proportional manner based on the command signal generated. When using an ON/OFF valve, the valve may be sized and tuned so as to mechanically achieve a slow open. In any case, flow may be metered by the valve before pressure upstream of the valve has been equalized with pressure downstream of the valve. Equalized pressure may be determined, for example, by sensing pressure at the pump and determining when pressure at the pump reaches a predetermined amount. Subsequently, flow may be metered by the resistance of the pump rather than the valve after risk of jerk to the system has passed.

Figure 3:
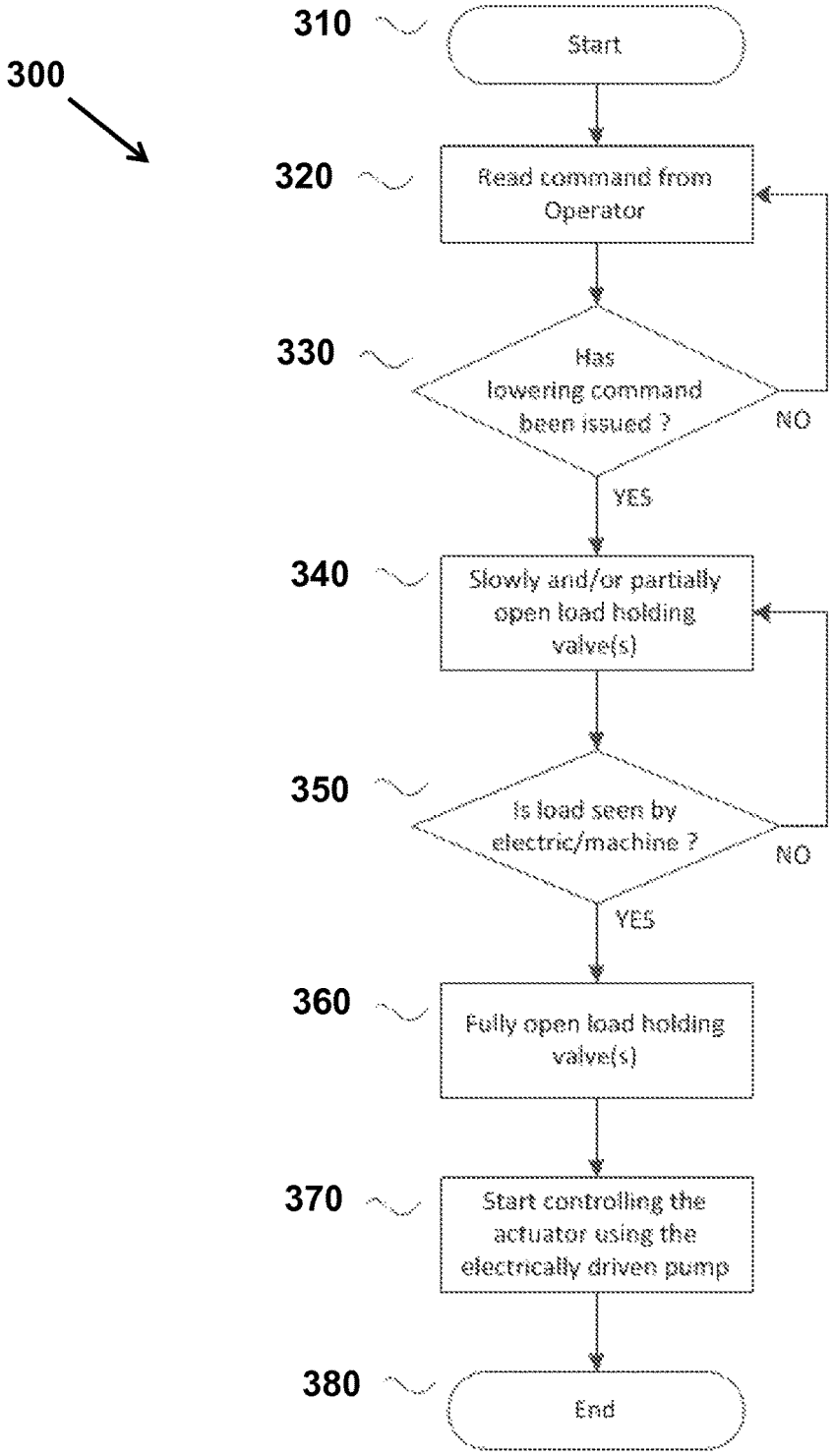
FIG. 3 illustrates a signal control flow diagram using proportionally controllable load holding valves to yield smooth control of actuator motion given a pressure difference between the cylinder and pump

Referring now in detail to FIG. 3, a signal control flow diagram illustrating method of controlling exemplary electro-hydrostatic actuator systems is shown at 300 to yield smooth control of actuator motion given a pressure difference between the cylinder and pump as described above.

The logic starts at the initial Start block 310.

Following this, at block 320, the operator interface or input device such as a joystick is monitored for an input signal. Although the monitoring may be continuous, other monitoring schemes are possible.

As long as no input signal is received, the system will continue monitoring the operator input device, as illustrated at block 330.

However, if the operator does issue a lowering command, load holding valve 180 will slowly and/or partially open at block 340. Block 340 may be implemented by a software routine to proportionally control opening of the load holding valve 180. For example, the valve may be opened so as to produce a small orifice and then opened fully once pressure is equalized. Alternatively, the valve may be opened slowly but continuously. Further, if an ON/OFF valve is being used, it is possible to size and/or calibrate the valve to cause a slow opening, thus approximating the dynamics of a proportionally controlled valve by selection of mechanical properties. In any case, opening the valve 180 in this manner will cause the actuator to smoothly accelerate with fewer or without any jerks or shocks caused by sudden pressure equalization.

An increase in pump pressure is monitored at block 350. Although any applicable sensing approach—such as the use of a pump pressure sensor—may be used, exemplary embodiments detect pressure by observing motor torque or current, for example, within the motor inverter 110. As long as no pressure increase is noticed or pressure increase is below an adjustable threshold, the load holding valve 180 will continue to further open or will stay open as a controlled-size orifice.

However, once pressure increase is noticed at block 350, the load holding valve 180 commanded fully open at block 360, and the electrically driven pump is commanded to generate hydraulic pump flow as commanded by the operator at block 370.

At block 380 the routine ends, and the electronically controlled pump may continue to control the actuator motion as desired by the operator.

The example of lowering a load (actuator retraction) where the load acts in the same direction as the desired actuator motion was used to illustrate the concept. It is obvious that depending on machine type, orientation of actuators, external load conditions etc. this method can be applied to in various ways. Another example would be to use this approach to control smooth start of an actuator extension under the effect of a pulling load. In general, the method is most suitable when direction of external load force and direction of desired actuator motion are the same.

While for purposes of simplicity of explanation, the illustrated method is shown and described above as a series of blocks, it is to be appreciated that the method is not limited by the order of the blocks, as some blocks can occur in different orders or concurrently with other blocks from that shown or described. Moreover, less than all the illustrated blocks may be required to implement an example methodology. Furthermore, additional or alternative methodologies can employ additional, not illustrated blocks.

In the flow diagram, blocks denote "processing blocks" that may be implemented with logic. The processing blocks may represent a method step or an apparatus element for performing the method step. A flow diagram does not depict syntax for any particular programming language, methodology, or style (e.g., procedural, object-oriented). Rather, a flow diagram illustrates functional information one skilled in the art may employ to develop logic to perform the illustrated processing. It will be appreciated that in some examples, program elements like temporary variables, routine loops, and so on, are not shown. It will be further appreciated that electronic and software applications may involve dynamic and flexible processes so that the illustrated blocks can be performed in other sequences that are different from those shown or that blocks may be combined or separated into multiple components. It will be appreciated that the processes may be implemented using various programming approaches like machine language, procedural, object oriented or artificial intelligence techniques.

In one example, methodologies are implemented as processor executable instructions or operations provided on a computer-readable medium. Thus, in one example, a computer-readable medium may store processor executable instructions operable to perform a method.

While FIG. 3 illustrates various actions occurring in serial, it is to be appreciated that various actions illustrated in FIG. 3 could occur substantially in parallel.

"Logic," as used herein, includes but is not limited to hardware, firmware, software or combinations of each to perform a function(s) or an action(s), or to cause a function or action from another logic, method, or system. For example, based on a desired application or needs, logic may include a software controlled microprocessor, discrete logic like an application specific integrated circuit (ASIC), a programmed logic device, a memory device containing instructions, or the like. Logic may include one or more gates, combinations of gates, or other circuit components. Logic may also be fully embodied as software. Where multiple logical logics are described, it may be possible to incorporate the multiple logical logics into one physical logic. Similarly, where a single logical logic is described, it may be possible to distribute that single logical logic between multiple physical logics.

"Software," as used herein, includes but is not limited to, one or more computer or processor instructions that can be read, interpreted, compiled, or executed and that cause a computer, processor, or other electronic device to perform functions, actions or behave in a desired manner. The instructions may be embodied in various forms like routines, algorithms, modules, methods, threads, or programs including separate applications or code from dynamically or statically linked libraries. Software may also be implemented in a variety of executable or loadable forms including, but not limited to, a stand-alone program, a function call (local or remote), a servelet, an applet, instructions stored in a memory, part of an operating system or other types of executable instructions. It will be appreciated by one of ordinary skill in the art that the form of software may depend, for example, on requirements of a desired application, the environment in which it runs, or the desires of a designer/programmer or the like. It will also be appreciated that computer-readable or executable instructions can be located in one logic or distributed between two or more communicating, co-operating, or parallel processing logics and thus can be loaded or executed in serial, parallel, massively parallel and other manners.

Suitable software for implementing the various components of the example systems and methods described herein may be produced using programming languages and tools like Java, Java Script, Java.NET, ASP.NET, VB.NET, Cocoa, Pascal, C#, C++, C, CGI, Perl, SQL, APIs, SDKs, assembly, firmware, microcode, or other languages and tools. Software, whether an entire system or a component of a system, may be embodied as an article of manufacture and maintained or provided as part of a computer-readable medium.

Algorithmic descriptions and representations used herein are the means used by those skilled in the art to convey the substance of their work to others. An algorithm or method is here, and generally, conceived to be a sequence of operations that produce a result. The operations may include physical manipulations of physical quantities. Usually, though not necessarily, the physical quantities take the form of electrical or magnetic signals capable of being stored, transferred, combined, compared, and otherwise manipulated in a logic and the like.

It has proven convenient at times, principally for reasons of common usage, to refer to these signals as bits, values, elements, symbols, characters, terms, numbers, or the like. It should be borne in mind, however, that these and similar terms are to be associated with the appropriate physical quantities and are merely convenient labels applied to these quantities. Unless specifically stated otherwise, it is appreciated that throughout the description, terms like processing, computing, calculating, determining, displaying, or the like, refer to actions and processes of a computer system, logic, processor, or similar electronic device that manipulates and transforms data represented as physical (electronic) quantities.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A method for smoothly controlling a hydraulic actuator configured to actuate an implement that is acted upon by an external load in a first direction, the method comprising the steps of:

receiving a command input to move the implement in the first direction;

upon receipt of the command input, opening a load holding valve hydraulically connected between a pump and a side of the actuator upstream of the pump a first amount to create a leakage path, the first amount being less than fully open;

monitoring the pressure at the pump, and fully opening the load holding valve once the pressure between the valve and the pump is equal to pressure between the valve and the actuator via the leakage path.

2. The method of claim 1, further comprising monitoring a command input device.

3. The method of claim 2, wherein the monitoring is continuous.

4. The method of claim 1, wherein the command input is a control signal generated by a user-controlled input device.

5. The method of claim 1 further comprising:

comparing the monitored pump pressure with a predetermined threshold.

6. The method of claim 5, further comprising:

further opening the load holding valve if the predetermined pressure threshold is not met.

7. The method of claim 5, further comprising:

fully opening the load holding valve when the predetermined pressure threshold is met.

8. The method of claim 5, wherein the monitoring pump pressure includes monitoring an electric current produced by a motor mechanically coupled to the pump.

9. The method of claim 1, wherein the step of equalizing pressure between the valve and the pump with pressure between the valve and the actuator occurs after opening the load holding valve the first amount.

10. A method for smoothly controlling a hydraulic actuator configured to actuate an implement that is acted upon by an external load in a first direction, the method comprising the steps of:

receiving a command input to move the implement in the first direction;

upon receipt of the command input, metering flow from the actuator via a load holding valve hydraulically connected between a pump and a side of the actuator upstream of the pump;

monitoring the pressure at the pump, and metering flow from the actuator via the pump once the pressure between the valve and the pump is equal to pressure between the valve and the actuator via the metered flow.

11. The method of claim 10 further comprising:

comparing the monitored pump pressure with a predetermined threshold.

12. The method of claim 11, further comprising:

further opening the load holding valve if the predetermined pressure threshold is not met.

13. The method of claim 11, further comprising:

metering the flow via the pump when the predetermined pressure threshold is met.

14. The method of claim 11, wherein the monitoring pump pressure includes monitoring an electric current produced by a motor mechanically coupled to the pump.

15. The method of claim 10, wherein the step of equalizing pressure between the valve and the pump with pressure between the valve and the actuator occurs after metering flow from the actuator via the load holding valve.

16. A hydraulic actuation system comprising:

a hydraulic pump;

a load holding check valve upstream of the pump;

a controller configured to generate and send command signals to the load holding check valve;

a sensor configured to monitor pump pressure;

wherein the load holding check valve is configured to partially open upon receipt of an open command signal, and wherein the load holding check valve is configured to fully open once the pressure between the valve and the pump is equal to pressure between the valve and the actuator.

17. The system of claim 16, wherein the pressure sensor senses current generated by an electric motor mechanically coupled to the pump.

18. The system of claim 16, wherein the controller is configured to generate a control signal to fully open the load holding check valve after pump pressure exceeds a predetermined pressure.

19. The system of claim 16, further comprising an inverter and an electric machine mechanically coupled to the hydraulic pump, the inverter configured to store electrical energy generated by the electric machine when the pump is driven by fluid flow.

* * * * *